US007278231B2

(12) United States Patent
Lowry

(10) Patent No.: US 7,278,231 B2
(45) Date of Patent: Oct. 9, 2007

(54) FORWARDLY EXTENDING PRODUCT INFORMATION TAGS FOR ELECTRONIC SHELF LABELS

(75) Inventor: Michael G. Lowry, Boca Raton, FL (US)

(73) Assignee: Fast Industries, Ltd., Fort Lauderdale, FL (US)

( * ) Notice: Subject to any disclaimer, the term of this patent is extended or adjusted under 35 U.S.C. 154(b) by 394 days.

(21) Appl. No.: 10/922,164

(22) Filed: Aug. 20, 2004

(65) Prior Publication Data

US 2005/0102874 A1 May 19, 2005

Related U.S. Application Data

(60) Provisional application No. 60/496,387, filed on Aug. 20, 2003.

(51) Int. Cl.
*G09F 3/00* (2006.01)

(52) U.S. Cl. ..... 40/642.01; 206/462

(58) Field of Classification Search ..... 40/642.01, 40/642.02, 657; 206/462
See application file for complete search history.

(56) References Cited

U.S. PATENT DOCUMENTS 4,694,595 A 9/1987 Fast
4,715,135 A 12/1987 Fast
4,773,172 A 9/1988 Fast
4,882,868 A 11/1989 Fast
4,888,897 A 12/1989 Fast
4,987,692 A 1/1991 Fast
5,040,316 A 8/1991 Fast
5,235,766 A 8/1993 Fast et al.
5,261,175 A 11/1993 Gebka
6,119,990 A 9/2000 Kump et al.
6,189,247 B1 2/2001 Gebka
6,279,256 B1 * 8/2001 Norolof et al. ..... 40/642.01
6,615,524 B2 * 9/2003 Valiulis ..... 40/638

OTHER PUBLICATIONS

U.S. Appl. No. 10/448,049, filed May 30, 2003, Lowry.

* cited by examiner

*Primary Examiner*—Gary C. Hoge
(74) *Attorney, Agent, or Firm*—Jacobson Holman PLLC

(57) ABSTRACT

An elongated, forwardly extending product information tag preferably die-cut from a thin sheet of plastics material to provide an integral proximal mounting portion, an elongated intermediate portion and a distal display portion, wherein the display portion includes a die-cut area defining, in one embodiment, a pair of spaced lower flexible tabs for engagement under the spring clips on the back of a standard ESL, and an upper elongated flexible flap for engagement over the top of the back of the ESL into the standard slotted area provided therein. In a second embodiment, the display portion includes a die-cut area of rectangular configuration.

6 Claims, 4 Drawing Sheets

FORWARDLY EXTENDING PRODUCT INFORMATION TAGS FOR ELECTRONIC SHELF LABELS

This is a complete application claiming benefit of provisional application Ser. No. 60/496,387 filed Aug. 20, 2003.

BACKGROUND OF THE INVENTION

1. Field of the Invention

This invention relates to product information tags for merchandise suspended from horizontally-extending support hooks, and the like. More particularly, the present invention relates to an elongated product identification and information tag of the type which is formed from a plastic sheet and which displays the product information forwardly of items suspended from a horizontally-extending hook.

2. Description of the Related Art

Product support hooks are commonly found in supermarkets, drug stores, and the like having a proximal portion engaged in, and carried by, a support such as an apertured board or the like, with the hook cantilevered in a horizontal direction to slidingly receive products or blister packs containing merchandise in a well known manner. Such product support hooks are commonly used with product information tags that include a mounting portion to be removably attached to the proximal end of the hook or directly to the support, with an integral intermediate portion projecting forwardly over the support hook and the supported merchandise, and an integral display portion extending downwardly from the distal end of the intermediate portion and in front of the hook to display desired product identification and information data to customers and/or store personnel for inventory and other such housekeeping operations.

Heretofore, the display portions of such forwardly extending product information tags carried adhesive or non-adhesive paper or plastic labels to provide purchasers with the unit price, promotional and nutritional information, and the like and, included bar codes or other inventory control information for the use of the store personnel. Such paper or plastic labels on the display portion of the product information tag were relatively light in weight enabling relatively thin product information tags to be utilized such as 0.015 to 0.020 inches in thickness. Rigidity and strength were provided by inclusion of longitudinally extending ribs, creases or bends generally three in number substantially parallel to each other. See U.S. Pat. Nos. 4,694,595; 4,715,135; 4,773,172; 4,882,868; 4,888,897; 4,987,692; 5,040,316; 5,235,766; 5,261,175; and 6,189,247.

Recently, electronic information carriers have been employed to provide product information. Electronic shelf labels (ESLs) are generally integrated with the in-store processor (ISP) or a free-standing controller that communicates with file information supporting the store's point-of-sale program. The ESL system may include low-voltage communication electronics or communication base stations (CBS) located in store ceilings away from the store operations. The ESLs are positioned throughout the store to identify an item's retail price and other information of interest to the consumer or for use by the store's inventory system.

Price changes may be initiated through the store's controller which updates item price files. This information, which has an association to a particular product identified by item number or UPC code, is communicated to the CBS in the ceiling and transmitted via a high frequency radio signal to the corresponding ESL. The ESLs are programmed with differing addresses that are also associated with the item number or UPC code of the product they represent. Once the addressed device is found, the label display changes and reflects an acknowledgment back to the CBS to confirm that the transmission was received and enacted. This acknowledgment is then communicated back to the ISP to complete the transaction. These systems, such as produced by NCR under its DecisioNet™ trademark, allow the ESLs to be independent of wires and cables below the ceiling, which reduces installation time and cost. Since there are no wires or cables required from the ceiling down, the label is free to be positioned anywhere. When store shelf resets occur, ESLs move easily with the shelves.

These ESL units, however, much like paper labels, require a carrier device to facilitate supporting them at selected locations, usually on the front of a store merchandise shelf. Several carriers for electronic shelf labels have been developed, including the device seen in U.S. Pat. No. 6,119,990, the subject matter of which is incorporated herein in its entirety by reference (the '990 patent). The '990 patent recognizes some of the problems associated with ESLs, with particular reference to adjusting the orientation of the carrier, and thus, the ESL, when it is secured directly to, for example, a C-channel at the front edge of a merchandise shelf or the like, to permit the viewer to more readily see the information, particularly if the electronic label is attached to a relatively low, or relatively high, shelf.

In co-pending application Ser. No. 10/448,049 filed May 30, 2003 (the '049 application), the subject matter of which is also incorporated herein in its entirety by reference, highly versatile carriers for ESLS, particularly adapted for supporting such elements at the front edge of a merchandise shelf to enable one or more of such devices to be positioned and repositioned in a simple and inexpensive manner, are disclosed which overcome many problems associated with the complexity and expense of the carrier of the '990 patent.

The ESL carriers of the '990 patent and the '049 application are not well adapted for supporting an ESL at the distal end of a forwardly-extending product information tag of the type discussed above where different requirements must be met. It is an ESL carrier formed on the display portion of an elongated forwardly-extending product identification and information tag with which the instant invention is concerned.

SUMMARY OF THE INVENTION

It is a primary object of the instant invention to provide an elongated, forwardly-extending product identification and information tag which includes, at its proximal end, any of a variety of mounting portions to enable the same to be supported at the proximal end of a merchandise support hook adjacent to an apertured board or other support, with an intermediate portion formed integrally with the mounting portion and adapted to project forwardly over a merchandise support hook, and an integral display portion at the distal end of the tag which incorporates means to simply and inexpensively receive and carry an ESL.

A further object of this invention is the provision of a forwardly-extending merchandise information tag die-stamped from a thin sheet of plastics material or the like, wherein the proximal end can be bent to form a mounting portion and the distal end can be bent to form a display portion adapted to removably carry an ESL.

Yet another object of this invention is to provide a forwardly-extending product information tag wherein the display portion is die-cut to define a pair of lower flexible tabs adapted to be inserted under the spring clips on the bottom of the back of a standard ESL, and an upper flexible flap adapted to be engaged in the slotted area at the top of the back of a standard ESL.

It is still another object of the present invention to provide a simple rectangular die-cut portion at the display portion that is free of any flexible tabs and flaps that can also support a standard ESL.

It is another object of the present invention to provide a robust, strong, relatively rigid product information tag for supporting an ESL which is thicker than typical tags with increased numbers of matrix creases to provide additional strength.

A still further object of this invention is the provision of an elongated, forwardly-extending product information tag which is extremely inexpensive to manufacture, yet simple to use even by an inexperienced clerk, to engage and support an ESL thereon, and to disengage an ESL therefrom for modification or replacement.

BRIEF DESCRIPTION OF THE DRAWINGS

These and other objects, features and many of the attendant advantages of the invention will be better understood upon a reading of the following detailed description when considered in connection with the accompanying drawings wherein.

Like reference characters refer to like parts throughout the several views of the drawings.

DETAILED DESCRIPTION OF THE PREFERRED EMBODIMENTS

Figure 1:
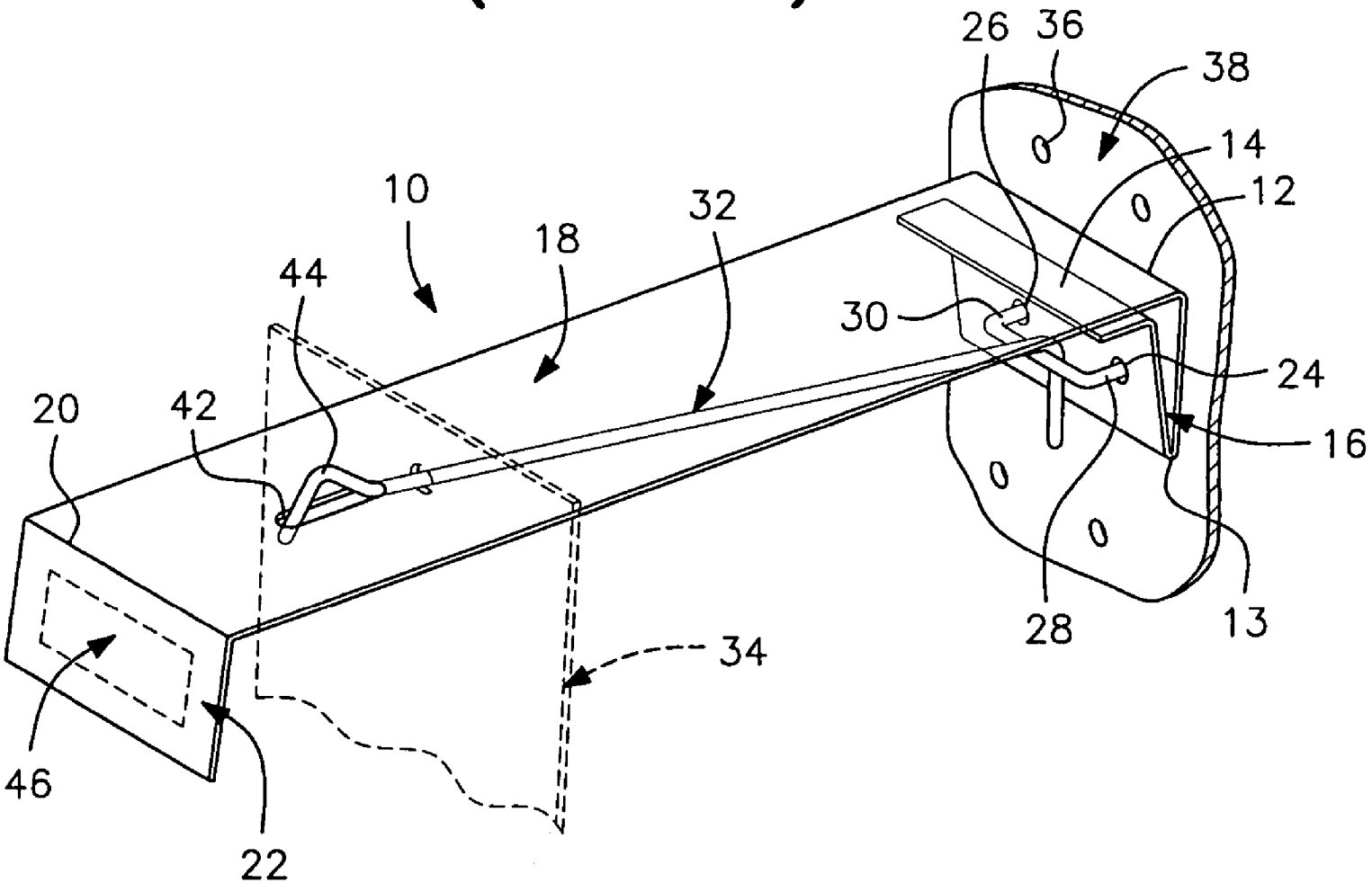
FIG. 1 (PRIOR ART)
FIG. 1 is a perspective view of a prior art forwardly extending product information tag.

In describing preferred embodiments of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Referring now to the drawings, and more particularly to FIG. 1, a prior art product identification tag of the type seen in U.S. Pat. No. 4,525,944 (the '944 patent), the subject matter of which is incorporated herein in its entirety by reference, is illustrated. The tag is identified generally by the reference numeral 10 and is comprised basically of a die-cut, relatively thin, sheet of any suitable plastics material with fold lines 12, 13, 14 to form a mounting portion 16 at the proximal end, an elongated intermediate portion 18, and a fold line 20 to form a display portion 22 at the distal end. Apertures 24, 26 (and mating apertures not shown) may be die-cut in the mounting portion 16 to receive a pair of ears or horns 28, 30 at the proximal end of an elongated, cantilevered, hook 32 adapted to slidingly receive apertured blister boards or products as shown in dotted lines at 34. The ears 26, 28 of the hook 32 are engaged in a well-known manner through the openings 36 of a support such as an apertured board 38 or the like. An adhesive label or the like, such as shown in dotted lines at 40, may be fixed to the display portion 22 to present consumer or inventory information at the distal end of the product support hook 32. A slot 42 may be die-cut into the intermediate portion 18 of the tag 10 to receive the distal end 44 of the merchandise support hook 32 to stabilize the tag 10 and limit side-to-side movement thereof in use.

For purposes of this invention, the details of the mounting portion 16 or, for that matter, the support 38, are not important. For example, modified mounting portions such as seen in U.S. Pat. Nos. 4,715,135, 4,703,570 and 5,040,316 can be substituted for the mounting portion 16. Further, for specialized supports, modified mounting portions such as seen in U.S. Pat. Nos. 4,646,454, 4,694,595, 4,698,929, 4,773,172, 4,882,868, 4,888,897, 4,987,692, 5,123,189, 5,235,766 or 5,261,175 can be utilized.

Similarly, while an integral display portion such as illustrated at 22 is preferable for use with an ESL-carrying, forwardly extending, product information tag according to the instant inventive concepts, a replaceable display portion such as seen in U.S. Pat. Nos. 4,754,563 or 4,965,949, or a hinged, replaceable display portion as seen in U.S. Pat. No. 5,421,113, may also be modified for use according to the instant inventive concepts.

Finally, the intermediate portion 18 can be planar as illustrated in FIG. 1 or can include longitudinally extending reinforcing perforations or ribs or creases as shown in U.S. Pat. No. 4,715,135, or others of the aforementioned patents, which also facilitates narrowing the strengthened intermediate portion of the tag. Typically, three longitudinally extending creases are utilized and the thickness of the tag is generally 0.015 to 0.020 inches.

The foregoing U.S. patents, the subject matters of all of which are incorporated herein in their entireties by reference, are intended to be illustrative, and not limiting.

Figure 4:
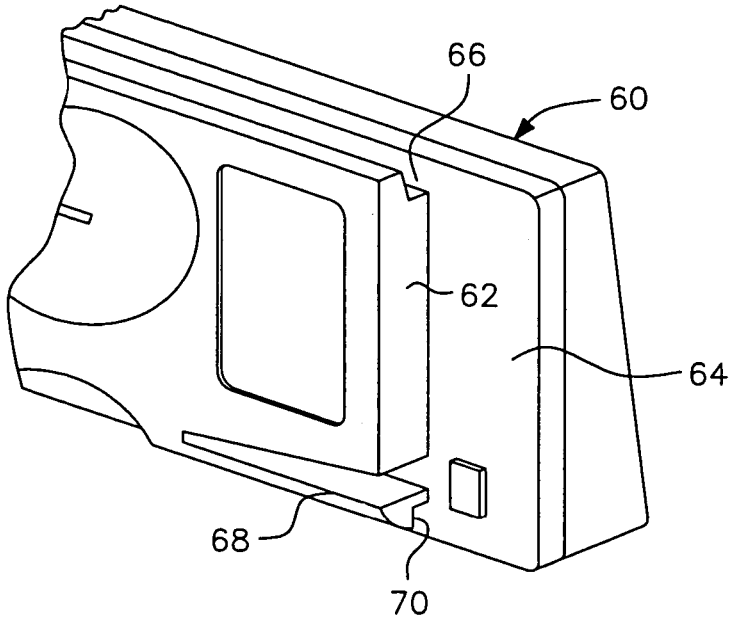
FIG. 4 is a fragmentary rear perspective view an ESL adapted to be supported by the product information tags of this invention.
Figure 5:
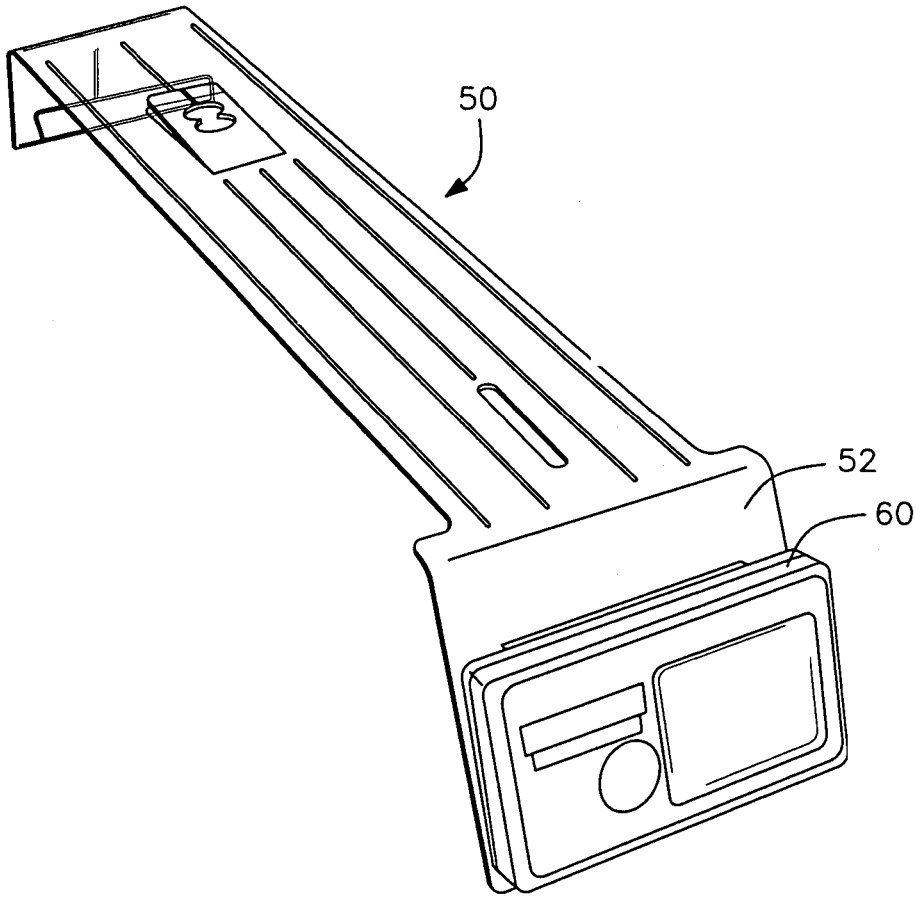
FIG. 5 is a perspective view of a forwardly extending product information tag according to this invention carrying an ESL on its display portion.

The essence of the instant inventive concepts relates to the display portion of an elongated, forwardly extending, product information tag of the type shown in the prior art, but adapted to support an ESL, rather than an adhesive or non-adhesive paper or plastic product information label. In this respect, reference is made to FIGS. 2-6 which illustratively show a preferred embodiment of a product information tag incorporating the instant inventive concepts at 50. The display portion 52 of the tag 50 is die-cut to define an opening 54 for removably receiving a standard ESL as shown illustratively at 60 in FIGS. 4 and 5. The details of the ESL are not critical to the instant inventive concepts although, for all intents and purposes, such products commonly include an enlarged, generally rectangular, boss 62 on the rear surface 64 thereof which defines an elongated slotted area 66 along its top and which includes a pair of spring clips 68 (only one of which is seen in FIG. 4) defining grooves 70 thereunder. The boss includes openings for receiving batteries and/or other electronic components.

Figure 2:
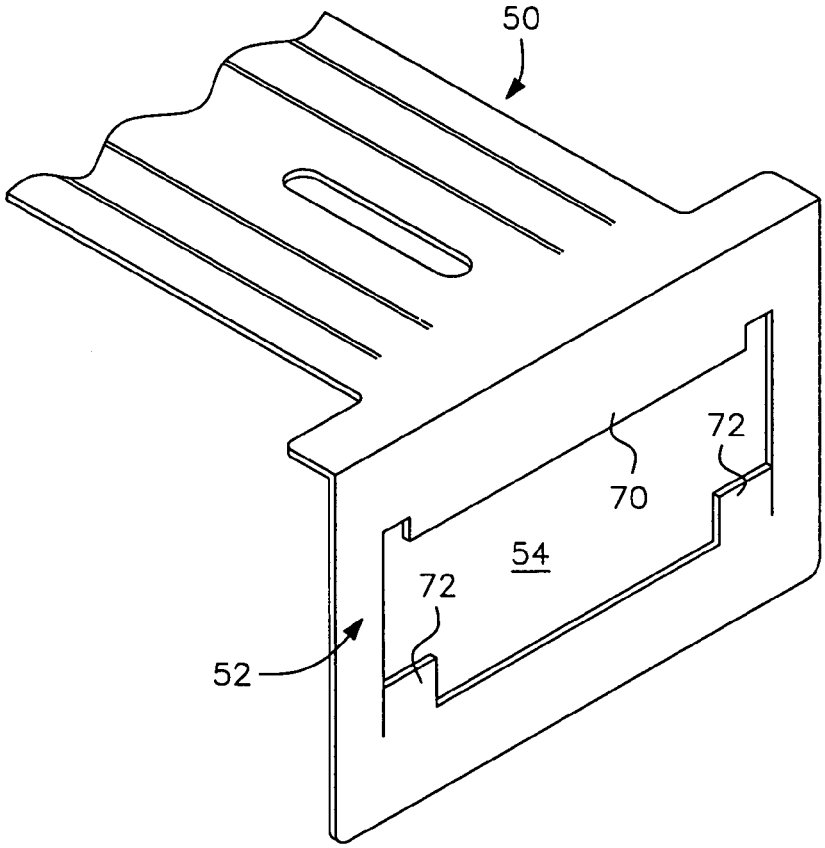
FIG. 2 is an enlarged fragmentary front perspective view of the distal end of a product information tag according to one embodiment of this invention adapted to support an ESL.
Figure 3:
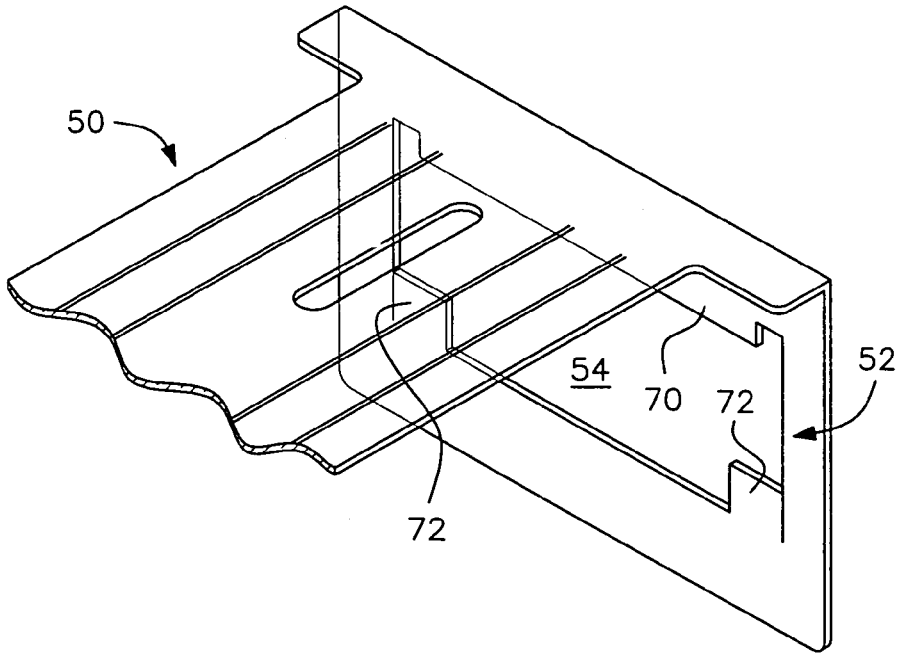
FIG. 3 is a fragmentary rear perspective view of the tag of FIG. 2.

The opening 54 of the embodiment of FIGS. 2 and 3 defines an elongated flap 70 along its upper end and a pair of spaced, resilient tabs 72 at its lower corners. In use, the tabs 72 are inserted into the grooves 70 under the spring clips 68 on the rear surface 62 of the ESL 60, and the elongated flap 70 is engaged over the back of the ESL 60 into the slotted area 66 thereby securing the ESL 60 to the display portion 52 of the product information tag 50. The relatively thin, resilient nature of the plastics sheet material from which the product information tag 50 is die-cut, facilitates resiliently engaging the tabs 72 and the flap 70 in the respective portions of the ESL 60. If desired, however, fold lines or the like (not shown) may be impressed into the display portion 52 of the product information tag 50 at the time the opening 54 is die-cut therefrom to weaken these areas and facilitate engaging the tabs 72 and flap 70 with the ESL 60.

Figure 6:
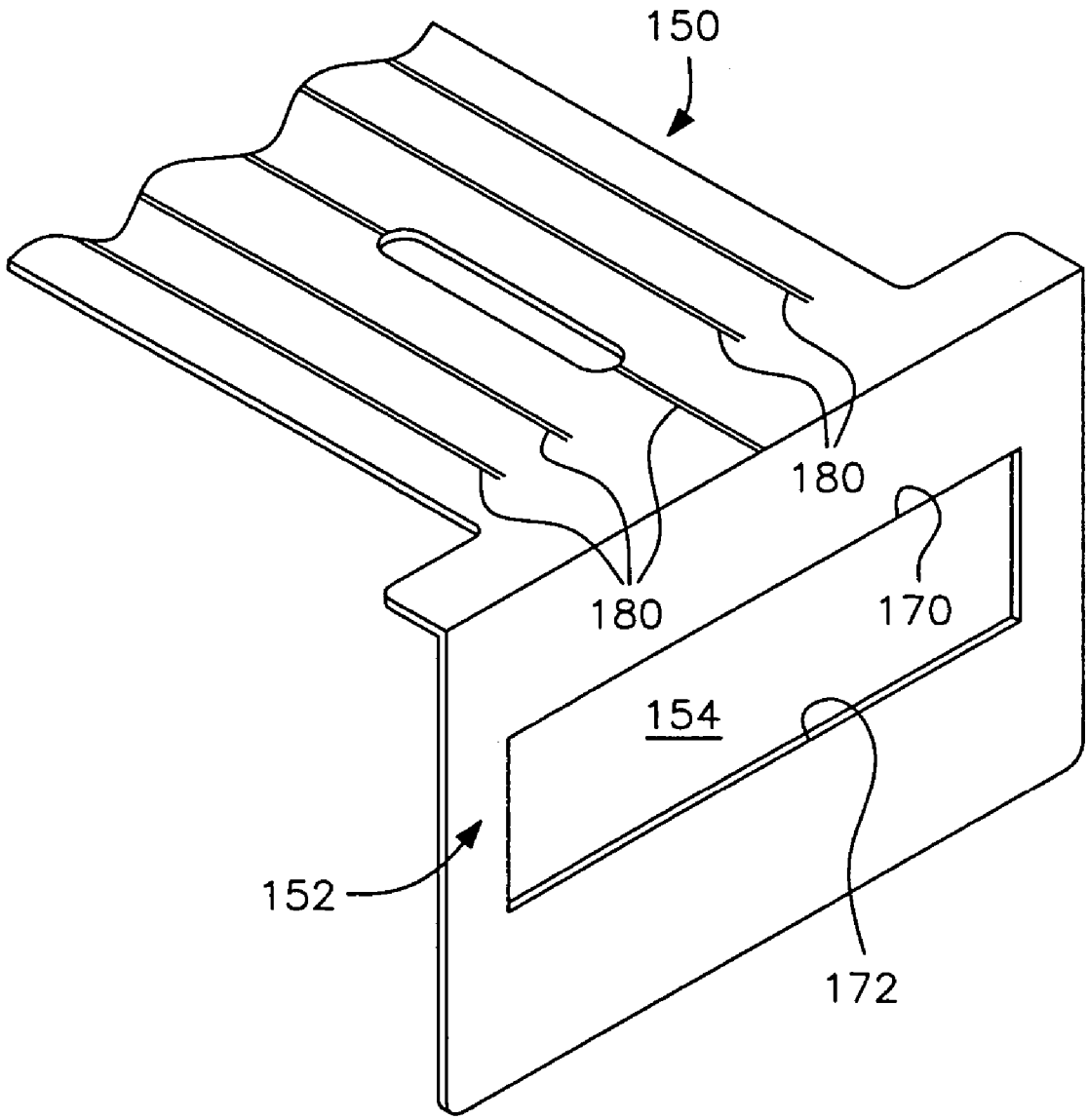
FIG. 6 is an enlarged fragmentary front perspective view of the distal end of a product information tag according to a second embodiment of the invention adapted to support an ESL.

With reference to the embodiment depicted in FIG. 6, the product information tag 150 includes a display portion 152 having a simple rectangular opening 154 which is die-cut from the display portion 152. The opening 154 is free of any tags or flaps. Instead, the rectangular portion is sized to receive the rear surface rectangular boss 62 at the rear of the ESL and the top edge 170 of the rectangular cut-out may fit within the slotted area 66 of the ESL. The bottom edge of the rectangular cut-out 172 is inserted into the grooves 70 of the ESL 60. Preferably, the distance between the top edge 170 and bottom edge 172 corresponds to the distance between the top of the tab 72 to the edge of the elongated flap 70. It should also be noted that the use of a rectangular opening or cut-out may be sufficient to support the ESL by just supporting the boss portion 62 without regard to the spring clips and grooves 70 or the slotted area 66.

Because the ESL is relatively heavy as compared to a simple paper or plastic adhesive label or the like that was affixed to the display portion of the prior art tags, it is preferred that the thickness of the product information tag be at least 0.030 inches which is substantially thicker than the standard product information tag. In addition, for increased strength, at least five longitudinal matrix creases 180, as shown in FIG. 6, are utilized. These matrix creases, configured similar to the longitudinally extending creases as are known in the prior art, may be utilized with the embodiment of FIGS. 2 and 3, as well as FIG. 6. In addition, the thickness of the product information tag of FIGS. 2 and 3 is similarly preferred to be 0.030 inches.

The use and operation of the forwardly extending product information tag of the instant invention will now be evident to those with ordinary skill in the art. As will be recognized, the preferred construction disclosed herein is a simple and inexpensive way to removably carry an ESL to present consumer and inventory information forwardly of the proximal end of a merchandise support hook.

The foregoing descriptions and drawings should be considered as illustrative only of the principles of the invention. Numerous applications of the present invention will readily occur to those skilled in the art. Therefore, as noted above, it is not desired to limit the invention to the preferred embodiments or the exact construction and operation shown and described. Rather, all suitable modifications and equivalents may be resorted to, falling within the scope of the invention.

What is claimed is:

1. A product information tag for use with an elongate hook attachable to a support surface for supporting products that are to be suspended on the hook, said tag comprising a first mounting end attachable adjacent the support surface, an elongate intermediate portion extending from said first mounting end for overlying the elongate hook, and a second free end with a display portion that is integrally connected with said intermediate portion by a fold line to enable said display portion to hang substantially perpendicular to said intermediate portion, said display portion including a substantially rectangular opening to receive and support an electronic shelf label ("ESL") to display product information, said substantially rectangular opening including a flexible lip along a top edge of the opening and a pair of flexible tabs extending upward from the bottom edge of the opening.

2. The product information tag of claim 1 wherein said tag is of substantially rigid PVC and said opening is a die-cut opening in said display portion.

3. The product information tag of claim 1 wherein said tag is plastic having a thickness of at least 0.030 inches.

4. The product information tag of claim 3 wherein said intermediate portion includes a plurality of longitudinally extending matrix creases extending in a direction from said first mounting end to said second free end.

5. The product information tag of claim 4 further comprising at least five matrix creases.

6. The product information tag of claim 1 wherein said substantially rectangular opening defines a major axis and a minor axis, the minor axis oriented perpendicular to said intermediate portion.

* * * * *